US005507228A

United States Patent [19]

Schulz

[11] Patent Number: 5,507,228

[45] **Date of Patent: *Apr. 16, 1996**

[54] PRINTING CYLINDER

[76] Inventor: Werner Schulz, 44 Hundred Acres Rd., Newtown, Conn. 06470

[ * ] Notice: The term of this patent shall not extend beyond the expiration date of Pat. No. 5,481,975.

[21] Appl. No.: 320,403

[22] Filed: Oct. 3, 1994

[51] Int. Cl.[6] ..... B41F 13/10

[52] U.S. Cl. ..... 101/375; 101/389.1; 492/4; 492/58

[58] Field of Search ..... 101/374, 376, 101/377, 382.1, 389.1; 242/72 B; 492/4, 5, 58

[56] References Cited

U.S. PATENT DOCUMENTS

| | | | |
|---|---|---|---|
| 3,146,709 | 9/1964 | Bass et al. | 101/375 |
| 3,166,013 | 1/1965 | Wyllie et al. | 492/4 |
| 3,253,323 | 5/1966 | Saueressig | 492/4 |
| 3,378,902 | 4/1968 | Hoexter | 492/4 |
| 3,782,234 | 1/1974 | Rodach | 83/665 |
| 4,030,415 | 6/1977 | Fellows | 492/4 |
| 4,144,813 | 3/1979 | Julian | 101/375 |
| 4,150,622 | 4/1979 | Stollenwerk et al. | 101/375 |
| 4,217,821 | 8/1980 | Vertegaal et al. | 101/375 |
| 4,272,872 | 6/1981 | Hess et al. | 492/4 |
| 4,365,566 | 6/1982 | Moss | 101/375 |
| 4,381,709 | 5/1983 | Katz | 101/375 |
| 4,455,903 | 6/1984 | Kesten | 83/346 |
| 4,624,184 | 11/1986 | Katz et al. | 492/4 |
| 4,651,643 | 3/1987 | Katz et al. | 101/375 |
| 4,656,942 | 4/1987 | Vertegaal | 101/375 |
| 4,685,393 | 8/1987 | Saueressig | 101/375 |
| 4,794,858 | 1/1989 | Katz | 101/375 |
| 4,812,219 | 3/1989 | Sattrup | 101/375 |
| 4,903,597 | 2/1990 | Hoage et al. | 492/4 |
| 4,913,051 | 4/1990 | Molinatto | 492/5 |
| 5,255,604 | 10/1993 | Dürr | 101/389.1 |
| 5,379,693 | 1/1995 | Hoffman et al. | 101/375 |

*Primary Examiner*—Eugene H. Eickholt
*Attorney, Agent, or Firm*—Lawrence Hager

[57] ABSTRACT

A new and improved printing cylinder or image carrier sleeve which is formed of either carbon fiber/particles or from a relatively thin flat sheet of metal. The flat sheet of metal, for example, stainless steel or tin, is rolled to form a cylinder of desired diameter and welded together along the longitudinal edges. The weld seam or spots may be filed to have a substantially flat and smooth surface. Also disclosed is a mandrel assembly having an outer expansion sleeve member with one or more yield or preferential expansion regions, for example, circumferential grooves for applying pressure to effect outward expansion of said outer sleeve member.

8 Claims, 3 Drawing Sheets

PRINTING CYLINDER

FIELD OF THE INVENTION

This invention relates to a new and improved printing roller or cylinder and, more particularly, to a relatively inexpensive and light weight cylinder having particular utility in combination with an expandable mandrel to secure the image carrier sleeves of selectable dimension or thickness.

BACKGROUND OF THE INVENTION

In certain types of printing, for example, gravure printing, a printing cylinder is utilized for the purpose of carrying the inked image or print for the printing operation. The ink is transferred from a cylindrical surface or cylinder to the paper surface that runs between an aligned impression roller and the printing cylinder. The printing cylinder is used to support a cylindrical sleeve like flexible printing plate, and the printing cylinder is designed to be rotatively mounted in a printing press or machine. Flexographic printing uses similar inks, however, the ink is deposited onto a rubber printing plate or sleeve mounted to a cylinder.

It should be recognized that in the course of various printing jobs or operations, it frequently becomes necessary to replace the image carrier sleeve or cylinder with another. Hitherto, various and relatively expensive methods have been proposed to provide a mandrel structure to enable demountable image cylinders for use in the printing machine.

Not infrequently in printing operations the entire mandrel structure is replaced in order to accommodate various circumference image cylinders. Such mandrel replacement is expensive and time consuming. Thus, a long recognized but heretofore unresolved problem of the prior art was the need to have and replace several mandrel type printing rollers to handle image cylinders having different inner diameters, or use of relatively expensive and complex mandrel adapter mechanisms which require valuable machine-down time to install.

Another problem of the prior art printing equipment which utilizes such mandrel arrangements is the confinement or limitation to the use of image cylinders being substantially of equal longitudinal dimensions as the printing cylinder or mandrel.

Another long felt but hitherto unresolved problem of the prior art was the generally recognized belief that only relatively expensive, thick walled and heavy image cylinders or image carrier sleeves made from a solid tubular steel or metal could be utilized on a gravure type printing press. This recognition was in part, justified due to the prior art type expandable mandrels which used frictional gripping at the end regions of the mandrels or journals, as more fully discussed below in the prior art statement.

Yet another long felt but unresolved problem of the prior art was the relative great cost of shipping, storing and handling of the prior art (relatively heavy) image cylinders.

PRIOR ART STATEMENT

A common method of changing printing cylinders is through heat treatment processes, wherein the cylinders are shrunk onto the journals at their ends, thereby forming a frictional fit between the rotating journals and printing cylinder carried thereon. In order to remove the cylinder, heat is applied to the journal cylinder interface allowing expansion of the cylinder to permit the cylinder to be removed from the journal.

One method to eliminate the heat treatment process for removing printing rollers from the mandrel is disclosed in U.S. Pat. No. 3,378,902 issued Apr. 23, 1978 to Rolf Hoexter. This method is a relatively complex, expensive and difficult system for forming pressure plates to carry a radial pressure outwardly to fix the printing cylinder at its spaced end sections to the mandrel by means of two outer collars.

As with the other prior art systems, this method requires the use of relatively thick walled and expensive image cylinders to avoid deformation of the cylinder between the pressure plates, i.e., the none supported or less supported intermediate regions not being frictionally engaged at the mandrel end regions. It being recognized that such deforming or outer diameter variation of the printing cylinder generally would result in none-uniform and unsatisfactory print quality.

Another prior art system is described in U.S. Pat. No. 4,381,709 issued May 3, 1983 to Robert Katz, wherein there is shown a three piece mandrel assembly which utilizes a hydraulic system to actuate two end rings to fix in-place a printing cylinder at its longitudinal end sections.

Once again this prior art mandrel assemble requires the use of the prior art type image printing cylinders having relatively thick walls and being expensive to produce, ship, store and handle.

In another prior art U.S. Pat. No. 4,651,643 issued Mar. 24, 1987 to Sidney Katz and Robert Katz, relatively expensive and complex adaptors for expandable mandrels of printing presses is disclosed. The adaptors are formed of annular members which are slidable over each end journal of a multi-piece mandrel and lockable thereto. The adaptors each have an outwardly expandable external periphery for gripping and holding a printing cylinder of a diameter larger than that of the mandrel. Thus, this prior art system describes an expensive, complicated and difficult to install system to attempt to adapt a mandrel to an image sleeve having a larger inner diameter than the diameter of the mandrel.

In yet another system as described in U.S. Pat. No. 4,150,622 issued on Apr. 24, 1979 to Joseph A. Stollenwerk, a system employing air pressure is employed in which compressible rings are adapted to be forced outwardly to hold the outer printing cylinder.

Other prior art references of interest are U.S. Pat. Nos. 4,812,219 issued Mar. 14, 1989 to Jane E. Sattrup; 4,794,858 issued Jan. 3, 1989 to Sidney Katz; 4,685,393 issued Aug. 11, 1987 to Karl Saueressig; 4,656,942 issued Apr. 14, 1987 to Jacobus-Gerardus Vertegaal, et al; 4,455,903 issued Jun. 26, 1984 to Martin Kesten; 4,386,566 issued Jun. 7, 1983 to Lester I. Moss; 4,144,813 issued Mar. 20, 1979 to Anthony P. Julian; 3,782,234 issued Jan. 1, 1974 to Alexander Rodach; 3, 146,709 issued Sep. 1, 1964 to W. E. Bass, et al.

In total contrast to the prior art, the present invention provides a relatively inexpensive, easy to use system which substantially solves many of the above noted prior art recognized problems and, in addition, incorporates structural simplicity and advantageous features hetherto not available.

For example, the present invention provides: a mandrel having a single circumferential pressure or hydraulic chamber, which extends substantially over the length of the mandrel; does not require seal gaskets between journal sections and the outer expansion jacket or sleeve; groove or contour means for effecting desired expansion/pressure regions or rings about said outer expansion sleeve to thereby provide a substantially uniform outer jacket expansion over a predetermined portion or virtually the full longitudinal length of the jacket with application of hydraulic pressure, which feature not only provides improved fictional gripping of the image carrier sleeve but enables the use of image carrier sleeves having different longitudinal length.

A further distinguishing feature of the present inventive system is the use of different outer diameter sized image carrier sleeves, with each having substantially the same inner diameter to enable being selectively slid onto the outer expansion jacket of the present inventive mandrel structure.

A yet further distinguishing feature of the present invention is the use of carbon fiber or particles to form image carrier sleeves.

Another distinguishing feature of the present invention is the use of flat sheet metal rolled and joined at its edges to form relatively thin and inexpensive image carrier sleeves.

Yet another distinguishing feature of the present invention is the substantial elimination of poor print quality resulting from none uniform expansion and frictional gripping across the juxtaposed surfaces of the expandable mandrel and the inner diameter surface of the image printing sleeve.

Another distinguishing feature of the present invention is the relatively greater frictional gripping surface to print image sleeve weight and mass.

Some of the distinguishing functional features of the present invention are:

- that a printer will require relatively few mandrel type cylinders;
- the use of a plurality of relatively inexpensive and light weight image carrier sleeves formed of carbon fiber or a flat rolled sheet metal, each having substantially the same inner diameter;
- the ability of using various image carrier sleeves having different outer diameters on the same mandrel without installing adjustment collets, etc.;
- that the shipping costs, of the relatively light weight image carrier sleeves, from the engraver to the printer are substantially reduced or constrained;
- that the handling and storage difficulties and expenses are curtailed;
- that any down-time typical with the prior art to replace image carrier sleeves is substantially reduced;
- that the operational down-time required in the prior art to retrofit the presses with different sized mandrels is substantially, if not fully, eliminated by the use of image carrier sleeves having selectively different thickness in accordance with the present invention; and
- that frictional gripping is relatively uniformly distributed across the inner diameter surface of the image carrier sleeve.

SUMMARY OF THE INVENTION

A printing system similar to a so-called gravure or flexographic process, wherein the improvement, in combination, comprises:

a mandrel assembly to facilitate or effect a virtually uniform expansion of said outer jacket with hydraulic pressure being applied within said mandrel; and an image carrier sleeve formed of carbon fiber or from a relatively thin sheet of flat metal rolled into a tubular shape of desired diameter and with an inner diameter dimensioned for selectively being slidingly mounted on said outer mandrel jacket.

Another feature of the present invention is the provision of an image carrier sleeve formed of carbon fiber particles.

Another feature of the invention is the provision of an image carrier sleeve formed from a relatively thin flat sheet of stainless steel or other suitable metal.

OBJECTS OF THE INVENTION

An object of the present invention is to provide a new and improved printing system.

Another object of the present invention is to provide a new and improved image printing cylinder.

Another object of the present invention is to provide a new and improved light weight image printing cylinder.

Another object of the present invention is to provide a new and improved mandrel assembly having an outer expandable circumferential jacket.

Another object of the present invention is to provide a new and improved mandrel assembly having an outer expandable circumferential jacket with a longitudinal length substantially or approximately equal to the length of the image printing cylinder.

Another object of the present invention is to provide a circumferential hydraulic chamber being longitudinally coextensive with the image carrier sleeve.

Another object of the present invention is to provide a mandrel assembly having inner and outer coaxial sleeves with a hydraulic chamber therebetween each being substantially of equal length with the image carrier sleeve.

Another object of the present invention is to provide a mandrel assembly having a relatively less expensive, less complex and more reliable hydraulic system.

Another object of the present invention is to provide a mandrel system capable of mounting/accommodating image printing/carrying cylinders having substantially and relatively different longitudinal lengths and/or thickness.

Another object of the present invention is to provide a new and improved mandrel assembly for effecting relatively greater and uniform frictional gripping of the image printing cylinders across its entire inner circumference and length.

Another object of the present invention is to provide a none metallic, for example, carbon fiber, image printing cylinder.

Other objects, advantages and structural/functional features of this invention will become more apparent from the following description.

BRIEF DESCRIPTION OF THE DRAWINGS

The invention will now be described with reference to the accompanying drawings, which are illustrative of the preferred embodiments of the invention. Like reference numerals refer to like parts throughout.

DETAILED DESCRIPTION OF THE PREFERRED EMBODIMENTS OF THE INVENTION

Figure 1:
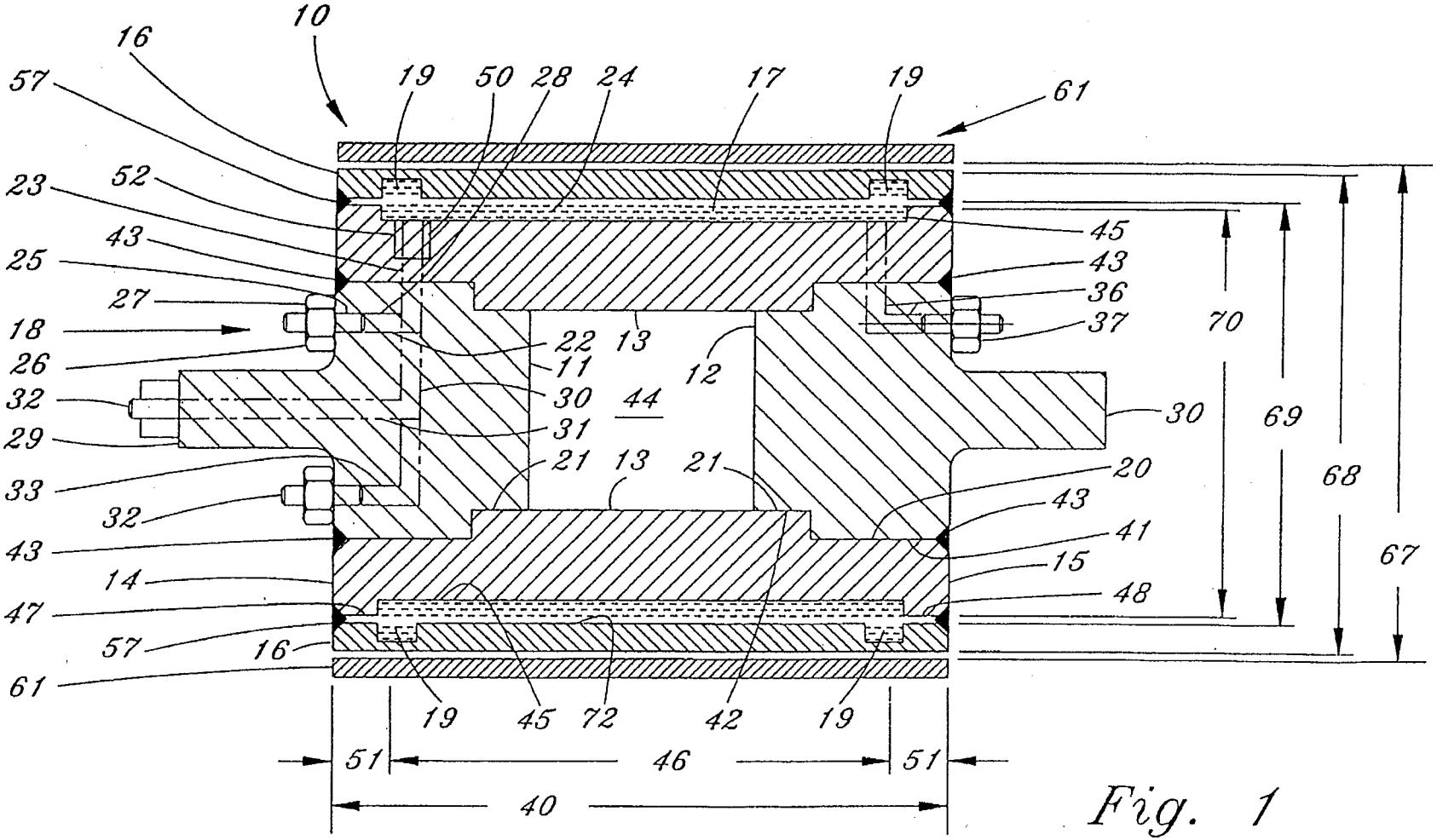
FIG. 1 is a longitudinal sectional view through a printing roller according to one embodiment of this invention.

With reference now to FIG. 1, there is shown an expandable mandrel or printing roller 10 with an image printing sleeve 61 being mounted thereon in accordance with the present invention.

In basic terms, the expandable mandrel 10 generally comprises a pair of spaced end journal members 11, 12, an inner or central sleeve 13 circumferentially mounted at its end regions 14, 15 to a respective end journal 11, 12, an outer expandable sleeve or jacket 16, a pressure chamber 17, a pressure or hydraulic delivery system 18, and one or more expansion grooves or selective expansion means 19.

Each end journal member 11, 12 is formed of suitable material such as steel and has a circular outer configuration 20 of predetermined diameter, and a lower circumferential ledge 21. One or both journal members 11, 12 contain hydraulic fluid passageways 22, 23 for containing hydraulic fluid 24. In accordance with this embodiment of the invention, only one end journal member 11 need contain drill holes or throughbores 22, 23 comprising a portion of the hydraulic system 18. It being noted that an advantage of the present invention is the ability to provide a relatively less complex and less expensive hydraulic throughbores 22, 23 in only one end journal member 11. The mouth end of throughbore 22 contains female threads 25 for matingly receiving the male threads of a hydraulic actuator 26. The hydraulic actuator 26 contains exterior sections such as a hexagonal nut like portion 27 which when manually rotated clockwise and counter-clockwise causes the hydraulic plunger 28 to be selectively displaced inwardly and outwardly.

Each end journal member 11, 12 has an outwardly projecting trunnion 29, 30, respectively, which are used to rotatably mount the mandrel 10 onto the printing press (not shown). Since such trunnion 29, 30 mounting members are conventional, detail discussion thereof will be omitted to avoid prolixity.

Shown in phantom dot dash outline is an alternative drill hole(s) 30, 31 and hydraulic actuator 32 placement. It is noted that although the alternative hydraulic passageways 30, 31 embodiment would require somewhat longer drill holes, such placement may be desired for selected purposes and printing operation/equipment without departing from the teachings of this invention.

Another alternative embodiment shown in phantom dotted outline of the hydraulic fluid passageways includes a release valve 32 and connecting throughbore 33, shown in phantom outline. In usual operation a separate release valve 32 may be superfluous or redundant, since the main adjustment valve 27 may be rotated, for example counter-clockwise, to outwardly displace the plunger and, thereby, reduce or release the hydraulic pressure within the hydraulic system. However, it is contemplated that for selected operations a separate release valve 32 may be desired.

Another alternative embodiment shown in phantom outline 35 is a second hydraulic fluid passageway 36 and adjustment valve 37 provided in the other end journal member 12. In this manner, the press operator can select the most accessible end of the mandrel 10 to effect hydraulic fluid pressure.

Another alternative embodiment of the hydraulic actuator is the use of high pressure grease fittings (not shown) in addition to or in place of the closed plunger system described above in detail.

Thus, a feature of the invention enables hydraulic pressure adjustment from only one end or, alternatively, either or both end journal members 11, 12.

The inner sleeve 13, made of suitable metal, generally defines the longitudinal length 40 of the body portion of mandrel 10. Each end of inner sleeve 13 contains a double ledge arrangement 41, 42 extending circumferentially and dimensioned for matingly engaging the circumferential ledges or platforms 20, 21 provided on each end journal 11, 12, respectively. The inner sleeve 13 is snugly or force fitted onto each end journal member 11, 12, and maybe secured, for example, by weld spots 43, thereto to prevent relative rotation between the constituent mandrel members 11, 12, 13. In this manner, a body portion of mandrel 10 is configured having a central hollow core 44 and a circular elongate exterior. The outer circumferential surface of inner sleeve 13 is provided with an undercut or alcove 45 to a predetermined depth, for example to a depth of 0.010 inch, and extending laterally or longitudinally across a selected predetermined portion 46 of the main body portion 40. In the preferred embodiment of the invention the undercut 45 extends substantially the entire length 40 of the main body portion of mandrel 10, while leaving a raised circumferential outer ring 47, 48 on each end of said inner sleeve 13. Notwithstanding, it is contemplated that alternative embodiments of the invention may utilize varied dimensional undercuts, for example, having a length substantially less than the length of mandrel 10. A throughbore is drilled through inner sleeve 13 in alignment with the throughbore 23 located in end journal member 11. It should be noted that an enlarged throughbore 50 may be drilled into inner sleeve 13 and downwardly a desired depth into end journal member 11 to provide an enlarged interconnected/aligned passageway with passageway 23. A seal type sleeve or gasket like member 52 may be inserted into throughbore 50 to avoid or prevent hydraulic fluid leakage between the juxtapositioned surfaces 20, 41 of the journal member 11 and inner sleeve 13.

The outer expandable jacket 16, generally made of suitable metal, has a selected thickness, and a longitudinal length 40 generally equal to or slightly less than that of inner sleeve 13. Jacket 16 is tubular shaped and has a pair of spaced circumferential inner grooves or expansion channels 19. The inner diameter of jacket 16 is slightly greater than the outer diameter of inner sleeve 13, to enable jacket 16 to be slid onto inner sleeve 13. A circumferential welding 57 is provided on each end of jacket 16, to coaxially attach jacket 16 onto and about inner sleeve 13 and to provide circumferential seals therebetween. In this manner, a circumferential and laterally extending hydraulic expansion or pressure chamber 17 is provided. The inner grooves 19 are dimensioned and located, for example, empirically, in order to effect a generally uniform outward circumferential expansion of jacket 16 with application of hydraulic pressure within chamber 17. An inner groove 19 being approximately a distance 51 of 0.250 inch from each end of jacket 16, and being 0.125 inch wide and 0.025 inch deep has been successfully used to effect a substantially uniform expansion in the full region between the inner grooves, with an expansion jacket 16 having a general thickness 55 of 0.09 to 0.129 inch. It should be recognized that other means, for example, varying the channel depth dimensions or thickness of the central area or metallurgical makeup of the expansion jacket 16, may be utilized to effect a virtually uniform or desired circumferential outward expansion of jacket 16 across a longitudinal expanse substantially Co-extensive with the main body of mandrel 10, in accordance with one feature of this invention.

The hydraulic pressure system 18 generally comprises expansion chamber 17, hydraulic passageways 22, 23 and the adjustment plunger 28, to control the hydraulic fluid pressure therewithin.

The image printing sleeve 61, described in greater detail hereafter, is designed and dimensioned for being slid onto the expansion mandrel 10.

The system contemplated in accordance with the present invention comprises an expandable mandrel 10 having means or expansion jacket 16 which provides improved fictional gripping over a relatively large axial surface area 46 and the ability of selectively using image printing sleeves 61, 62 having relatively thin 75 wall thickness.

As will be appreciated, while hydraulic actuator or plunger means have been described, other means of pressurization of chamber 17 can be employed.

Figures 2A, 2B:
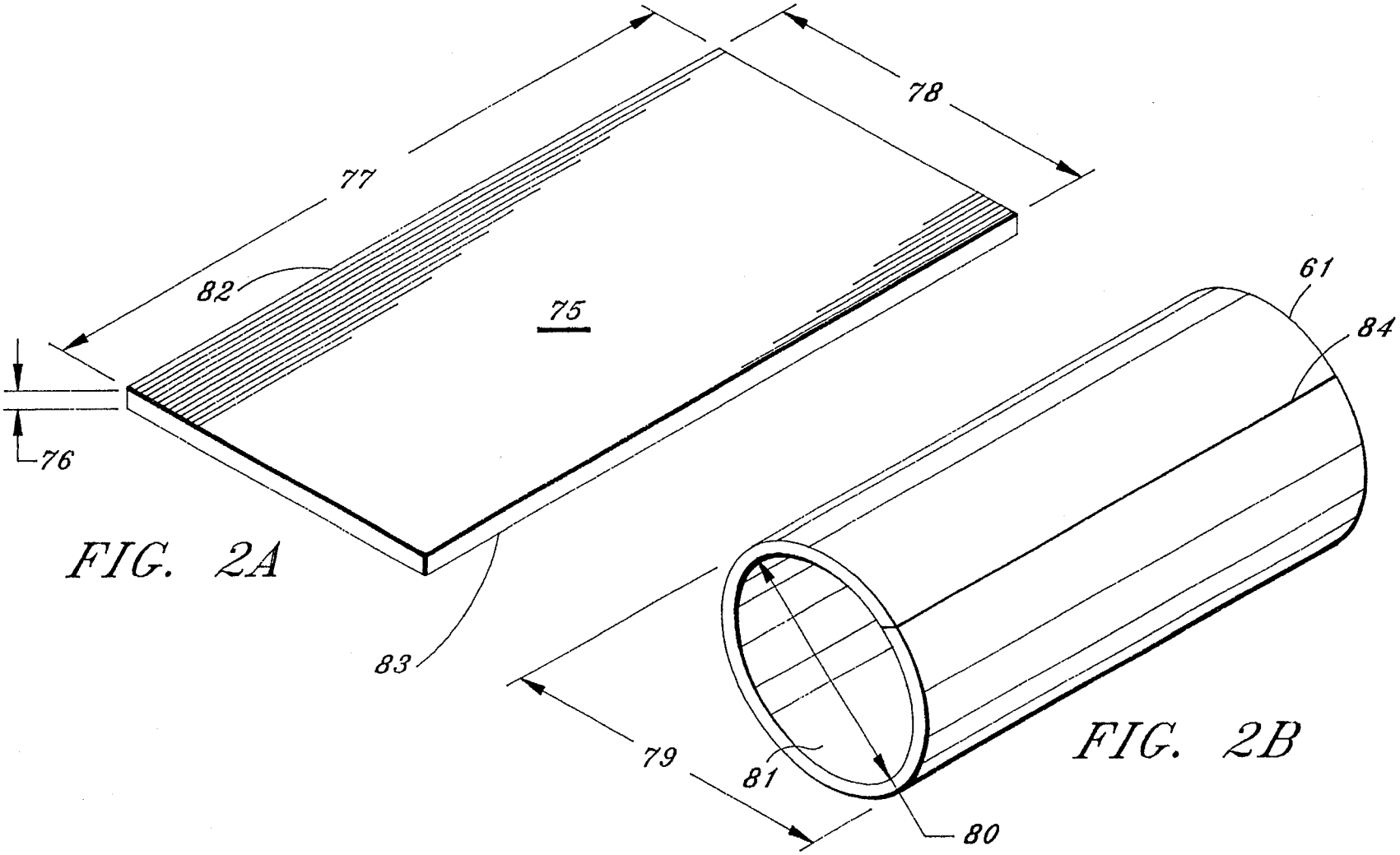
FIG. 2*a* is a perspective view of a relatively thin, light weight and flexible flat sheet of metal such as stainless steel used in forming an image printing cylinder in accordance with an embodiment of the invention.
FIG. 2*b* is a perspective view of a relatively thin image printing cylinder formed from a piece of flat sheet metal as illustrated in FIG. 2*a* in accordance with the invention.

With particular reference now to FIGS. 2*a* and 2*b*, a first preferred embodiment of the invention will now be described in greater detail.

As previously pointed out, the prior art utilized a relatively inflexible, thick walled steel solid construction type cylinder to form a prior art type image printing sleeve (not shown) The machining of the stock tubing requires relatively expensive, laborious and time consuming machine shop labor. The prior art cylinder is relatively heavy, difficult to transport and store and, therefore, greatly increases the cost of each printing job. In addition, any denting or out-of-round defects developing in the image printing cylinder resulted in the costly and time delaying need for the printer to order a replacement cylinder. Typically, these ridged thick wall cylinders were required since they were mounted at their end regions such as discussed heretofore in the prior art statement.

An important feature of the present invention is the provision of a relatively thin walled, light weight and flexible cylinder 61*a*, 61*b* forming the base member of the image printing sleeve.

The cylinder 61*a* is formed from a flat sheet piece of metal, for example, stainless steel, 75 having a predetermined but relatively thin thickness 76. The length 77 and width 78 are selected to enable the contouring or rolling into a cylinder 61*a* having a desired length 77 and outer diameter 79. The inner diameter 80 is selected for enabling cylinder 61*a* to be snugly slid unto the expandable mandrel 16. The length 77 of cylinder 61*a* is generally selected to equal or be slightly less than the length 40 of mandrel 16. The longitudinal edges 82, 83 of sheet metal 75 are joined together by any suitable manner such as by a weld joint 84, which is filed or ground to a smooth surface.

The expandable sleeve 16 of mandrel 10 is designed to radially expand substantially uniformly over its entire length 40, to provide outward pressure in a relatively even manner against the entire inner surface 81 of image printing sleeve 61*a*. The relatively flexible thin wall 76 image printing sleeve 61*a* is compliantly conformed to and fictionally engaged by the outer surface of jacket 16 with application of hydraulic pressure within chamber 17.

In this manner, warping, bends, dents and out-of-round deformity which may have occurred in the prior art during handling, shipping and storage are substantially and without additional cost remedied. Thus, the relatively costly problem of cylinder defects inherent in the prior art system cylinders are substantially eliminated.

In addition, the cost of manufacture, shipment, handling and storing the image printing sleeve 61*a*, 61*b* are substantially reduced in accordance with the present invention.

The outer peripheral surface of cylinder 61*a* is plated, for example, with a copper layer 84, etched (not shown) and laminated or treated to form the printing image thereon in conventional manner. Since the plating and etching laminating process used is known in the prior art, a detailed description thereof is omitted to avoid prolixity.

This opportunity is taken to point out another advantage of the present system over the prior art. Due to the relatively flexible characteristic of the image printing sleeve 61*a* (61*b*) and the relatively uniform outward locking pressure on the inner wall surfaces of the image printing sleeve 61*a* (61*b*), the quality of the printing is substantially improved. This improvement results from the fact, in contradiction to the prior art, that the inner wall surfaces 81 are engaged and supported by an expandable jacket 16 substantially over the full length 77 of the image printing sleeve 61*a* (61*b*) as a result of increased frictional (area) engagement to the weight of the rotatably mass, i.e., image printing sleeve 61*a* (61*b*).

Figure 3A:
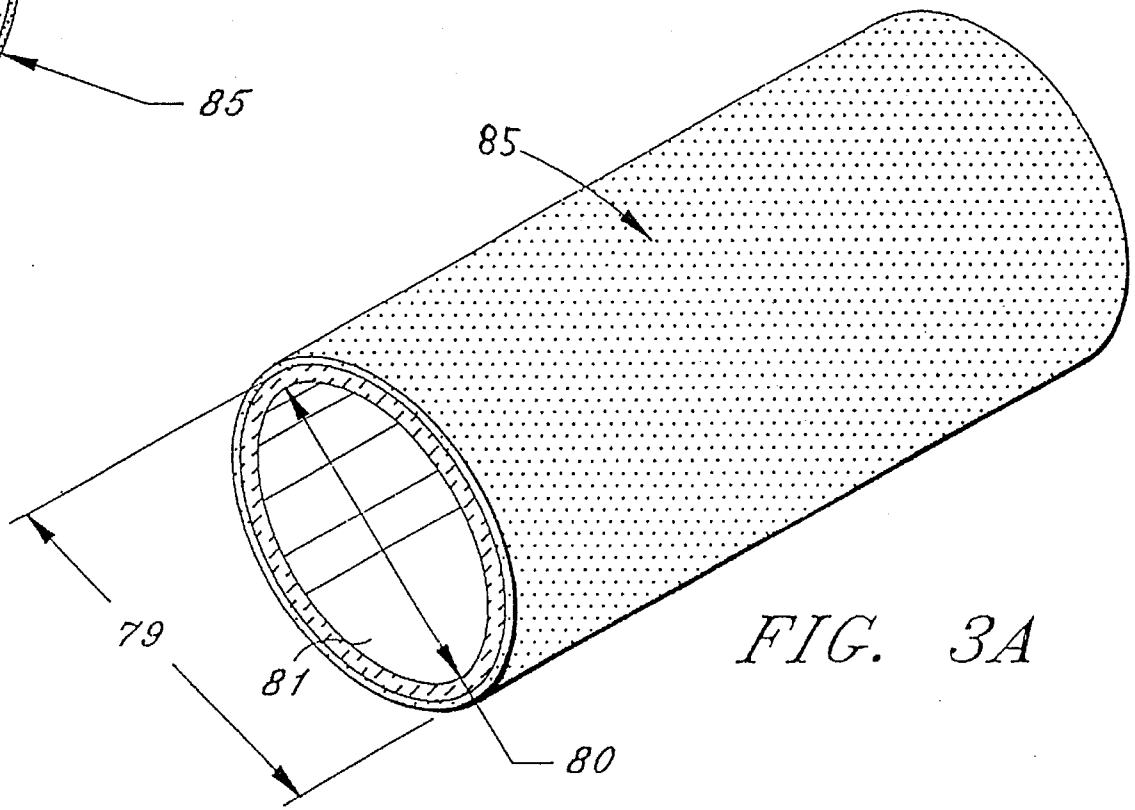
FIG. 3*a* is a perspective view of a relatively thin image printing cylinder formed of carbon fiber or particles in accordance with a second embodiment of the invention.
Figure 3B:
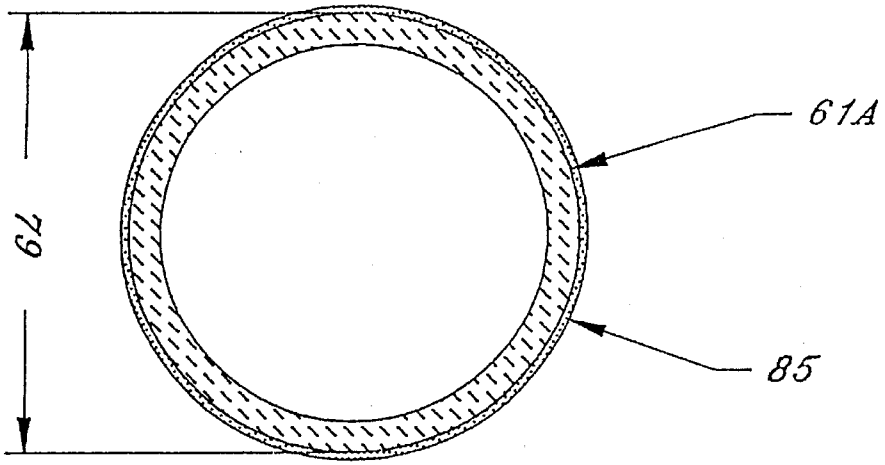
FIG. 3*b* is a plan end view of a relatively thin image printing sleeve formed of carbon particles/fiber in accordance with the invention.

With reference now to FIGS. 3*a* and 3*b*, another preferred embodiment of the invention will be described in detail.

FIG. 3*a* shows a perspective plan view of a cylinder 61*a* formed of a light weight material, such as for example, carbon particles or fibers, which is molded into the desired shape having a predetermined length 77, inner and outer diameters 80, 90. The carbon cylinder 61*b* has particular benefit in that it is relatively inexpensive to form, is light weight and is not subject to environmentally caused deterioration such as rusting. As shown in FIG. 3*b*, the carbon cylinder 61*b* is coated with, for example, a layer of copper 87 which is etched to form the printing image thereon.

While the principles of this invention have been described above in connection with specific embodiments, it is to be understood that this description is merely by way of example and not as a limitation as to the scope of the invention.

What is claimed is:

1. An image printing cylinder in combination with an expandable printing mandrel having particular utility for uniformly supporting the image printing cylinder, comprising:

a first tubular cylinder (13) having axial-spaced end portions each defining a respective cylindrical opening of predetermined dimension;

a pair of axial-spaced journal members (11, 12) each having an outer cylindrical portion received within a respective one of said cylindrical openings and affixed to the respective tubular end portion;

a second tubular cylinder (16) having an inner diameter (69) greater than the outer diameter (70) of said first tubular cylinder and being mounted thereon and affixed thereto, said second tubular cylinder having a circumferentially expandable portion axially extending (46) between said journal members;

actuatable pressure means (18) having a circumferential pressure chamber (17) axially and substantially co-extending with said expandable portion of said second tubular cylinder, said pressure chamber being generally defined between circumferentially spaced wall portions (45) of said first and second tubular cylinders;

an image printing cylinder (61*a*,61*b*) having a relatively thin wall (76) construction and being relatively light weight with an axial length (77) approximately co-extensive with the expandable portion (46) of said second tubular cylinder for being snugly and slidingly mounted thereon, whereby substantially the entire axial length of said image printing cylinder being subjected to a radially directed frictionally engaging and circumferentially outwardly defining force.

2. An image printing cylinder in combination with a mandrel as in claim 1, wherein:

the image printing cylinder is formed from a relatively thin flat sheet of stainless steel which is coated with a layer of copper that is etched to form the desired printing image.

3. An image printing cylinder in combination with a mandrel as in claim 1, wherein:

the image printing cylinder is formed from carbon fibers, which cylinder being laminated with a metal layer suitable for being etched.

4. An image printing cylinder in combination with a mandrel as in claim 1, wherein:

the image printing cylinder being formed from carbon particles and an outer copper laminated layer deposited thereon.

5. An image printing cylinder in combination with an expandable printing mandrel as in claim 1, wherein:

the first tubular cylinder (13) contains a circumferential alcove axially extending (46) slightly less than the full axial length (40) of said first tubular cylinder, and having a circumferential ledge member (47,48) about each respective end portion.

6. An image printing cylinder and expandable printing mandrel as in claim 1, wherein:

the second tubular cylinder contains wall portions defining two or more axially-spaced circumferential grooves means (19) for facilitating a relatively uniform intermediate expandable portion (46) thereof.

7. An image printing cylinder and expandable printing mandrel as in claim 1, wherein:

the pressure chamber (17) being substantially defined between an alcove and the inner diameter wall portions (72) of said second tubular cylinder.

8. An image printing cylinder and expandable printing mandrel as in claim 1, wherein:

the second tubular cylinder has two circumferential axially-spaced grooves (19) each being disposed approximately 0.25 inch from a respective end portion and being approximately 1/16 inch wide and 0.02 in depth.

* * * * *